US007530480B2

(12) United States Patent
Nan

(10) Patent No.: US 7,530,480 B2
(45) Date of Patent: May 12, 2009

(54) SEAMLESS MANNEQUIN AND PROCESS OF MANUFACTURE THEREOF

(75) Inventor: Simon Siu Man Nan, Ontario (CA)

(73) Assignee: Nanma Manufacturing Co., Ltd., Hong Kong (CN)

( * ) Notice: Subject to any disclaimer, the term of this patent is extended or adjusted under 35 U.S.C. 154(b) by 393 days.

(21) Appl. No.: 10/984,294

(22) Filed: Nov. 9, 2004

(65) Prior Publication Data

US 2006/0097016 A1 May 11, 2006

(51) Int. Cl.
*A41H 5/02* (2006.01)
*A63H 3/06* (2006.01)
*B63C 9/15* (2006.01)

(52) U.S. Cl. ..... 223/67; 441/94; 441/41; 600/38

(58) Field of Classification Search ..... 446/220–226, 446/385; 428/542.2, 7; 223/67; 600/38
See application file for complete search history.

(56) References Cited

U.S. PATENT DOCUMENTS 1,318,113 A 10/1919 Scott
2,053,371 A * 9/1936 Lee ..... 156/61
2,606,398 A 8/1952 Miller
3,689,613 A 9/1972 Talalay
3,769,134 A 10/1973 Livingston
3,773,097 A 11/1973 Mullins
3,801,403 A 4/1974 Lucek
4,213,267 A * 7/1980 Curtis ..... 446/221
4,820,231 A 4/1989 Mikitka et al.
4,828,528 A * 5/1989 Chatkis ..... 446/320
4,908,001 A 3/1990 Kopian
5,180,455 A 1/1993 Cheng
5,340,350 A 8/1994 Fink et al.
5,419,729 A 5/1995 Gross
5,467,543 A 11/1995 Fink et al.
5,500,456 A 3/1996 Hughett et al.
5,913,708 A * 6/1999 Gross ..... 446/385
5,961,426 A * 10/1999 Spector ..... 482/83
6,106,348 A 8/2000 Loisel
6,299,817 B1 10/2001 Parkinson
6,558,498 B1 5/2003 Man
6,758,715 B2 * 7/2004 Banks ..... 446/221
6,889,723 B2 5/2005 Gerresheim et al.

OTHER PUBLICATIONS

Merriam-Webster Online dictionary (www.m-w.com/dictionary/inflated) term search was "inflate".*

* cited by examiner

*Primary Examiner*—Timothy M Speer
*Assistant Examiner*—Gordon R Baldwin
(74) *Attorney, Agent, or Firm*—Ari M. Bai; Polsinelli Shughart PC

(57) ABSTRACT

A seamless life-like mannequin comprising a unitary inflatable outer body with an inflatable inner body disposed therein and a related process of manufacturing such a mannequin is disclosed. The outer body of the mannequin comprises a torso portion and a head portion with a seamless transition between the two portions for providing a realistic life-like appearance to the mannequin.

3 Claims, 4 Drawing Sheets

SEAMLESS MANNEQUIN AND PROCESS OF MANUFACTURE THEREOF

FIELD OF THE INVENTION

The present invention relates to a mannequin and process of manufacturing the same.

BACKGROUND OF THE INVENTION

There are many inflatable products available on the market today. Generally, these products assume a substantially flat, two-dimensional shape when deflated, and a three-dimensional shape when inflated. The inflated product is often one that provides buoyancy in the water, and has a nondescript geometric shape. However, novelty inflatable products that assume a recognizable shape when inflated are also available. Some of these novelty products are animal-shaped, and are sold as toys for children. Others are shaped like human mannequins, either for use in displaying items of clothing, or for sale as an adult novelty.

Typically, an inflatable mannequin may comprise an outer body including a torso portion mechanically connected to a head portion in order to provide life-like features to the mannequin. In order to produce such life-like features the head portion may be produced separately using a slush and rotational moulding process whereby a life-like head sculpture mould is provided to create an accurate face configuration for the head portion of the mannequin, while a separate torso portion mould is provided to create a realistic torso portion having limbs with both portions being made by a latex dipping process. Eventually, the torso portion and the head portion are removed from respective moulds and must be mechanically joined together to produce the finished life-like mannequin. However, mechanically joining the torso portion with the head portion produces a distinct joining line or seam along the connection site between the two joined portions that may detract from the life-like features of the mannequin.

Therefore, there is a need in the art for a mannequin having a unitary outer body that has a seamless transition between the torso portion and the head portion. Further, there is a need in the art for a process of manufacturing such a seamless mannequin having a unitary outer body that does not require the step of mechanically joining the torso portion to the head portion.

SUMMARY OF THE INVENTION

A primary object of the present invention is to provide a mannequin having life-like features.

Another object of the present invention is to provide a mannequin having a unitary outer body that has a seamless transition between the torso portion and the head portion of the mannequin.

Yet another object of the present invention is to provide a mannequin having an inflatable inner body disposed inside the outer body of the mannequin.

Another further object of the present invention is to provide a process of manufacturing a mannequin having a unitary body that does not require joining the torso portion with the head portion of the mannequin.

A further object of the present invention is to provide a process for manufacturing a mannequin that permits the inflatable inner body to be inserted into the outer body through an opening formed along the head portion during manufacture.

Yet another further object of the present invention is to provide a life-like mould having a torso member, head member, and tubular member adapted for producing a seamless mannequin in a latex dipping process.

In a preferred embodiment, the present invention comprises a seamless life-like mannequin comprising an inflatable outer body, the outer body including a torso portion and a head portion, and an inflatable inner body disposed inside the outer body, wherein the mannequin has a seamless transition between the torso portion and the head portion of the outer body.

In another embodiment, the present invention comprises a process for manufacturing a seamless life-like mannequin comprising the steps of:

a) providing a mould comprising a torso member and a head member, the mould adapted to be used in a latex dipping process, the head member including a tubular member;

b) immersing the mould into a bath of liquid latex for a predetermined amount of time for producing a latex coating on the mould;

c) removing the mould having the latex coating from the bath of liquid latex, the latex coating having an inner surface and an outer surface;

d) removing the latex coating having a head portion, torso portion and tubular portion from the mould, the head portion, torso portion and tubular portion of the latex coating being defined by the head member, torso member and tubular member of the mould, respectively, the outer body defining a chamber, the tubular portion defining a hollow conduit in communication with the chamber through an opening defined along the head portion;

e) cutting off the tubular portion from the head portion; and f) inserting an inner body inside the outer body through the opening.

In another embodiment, the present invention comprises a process for manufacturing a seamless life-like mannequin comprising:

a) providing a hollow inflatable outer body having a head portion and a torso portion, wherein the torso portion and the head portion have a seamless transition, the head portion defining an opening;

b) inserting an inflatable inner body through the opening of the outer body;

c) covering the opening of the head portion; and d) inflating the inner body and the outer body.

Additional objects, advantages and novel features of the seamless life-like mannequin and process of manufacture thereof will be set forth in the description that follows, and will become apparent to those skilled in the art upon examination of the following more detailed description and drawings in which like elements of the invention are similarly numbered throughout.

DETAILED DESCRIPTION OF THE INVENTION

Figure 1:
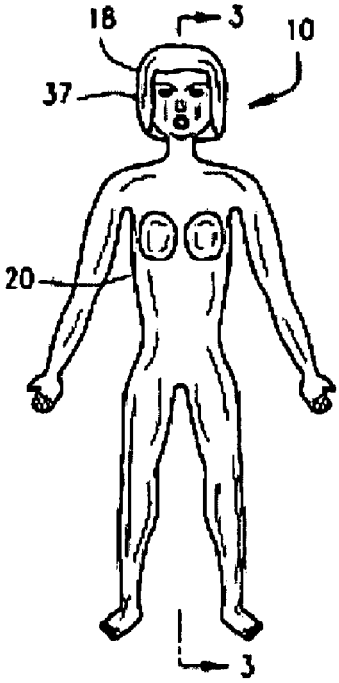
FIG. 1 is a front view of the seamless life-like mannequin according to the present invention.
Figure 3:
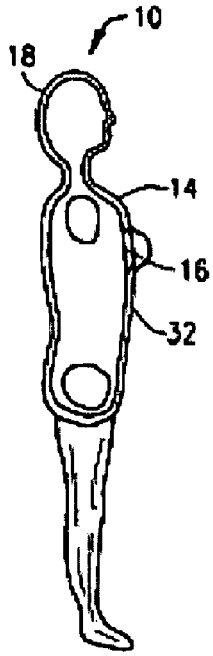
FIG. 3 is a cross-sectional view of the seamless life-like mannequin taken along line 3-3 of FIG. 1 illustrating the inner body disposed inside the outer body of the mannequin according to the present invention.
Figure 5:
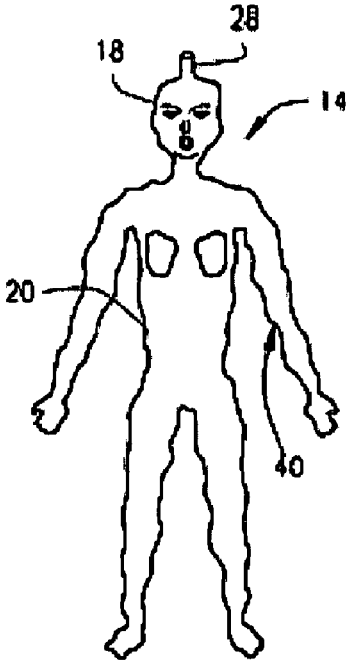
FIG. 5 is a front view of the latex outer body of the seamless life-like mannequin with a tubular member extending from the head portion of the mannequin according to the present invention.
Figure 6:
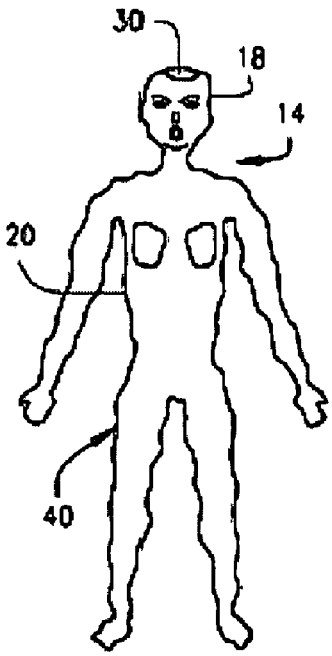
FIG. 6 is a front view of the latex outer body with the tubular member removed from the head portion defining an opening according to the present invention.

Referring to the drawings, the seamless life-like mannequin according to the present invention is illustrated and generally indicated as 10 in FIG. 1. As shown in FIG. 3, the seamless life-like mannequin 10 comprises an inflatable outer body 14 having a flexible inflatable inner body 16 disposed inside a chamber 32 defined by outer body 14. The outer body 14 comprises a head portion 18 and a torso portion 20 which are configured to provide the seamless life-like mannequin 10 with realistic human features, such as eyes, mouth, nose and limbs that impart a human appearance.

Referring back to FIG. 1, the outer body 14 is made of a unitary construction having a seamless transition between the torso portion 20 and the head portion 18. As used herein, the term "life-like" means that the seamless life-like mannequin 10 has a realistic human appearance, while the term "seamless transition" means that there are no seams or joining lines between the torso portion 20 and head portion 18 of the mannequin 10. Preferably, the outer body 14 is made of a latex material that may be produced using a latex dipping process as shall be discussed below.

As shown in FIG. 3, inflatable inner body 16 provides a flexible mannequin-shaped body adapted to be disposed inside outer body 14 and substantially conform to the shape of the outer body 14 during the manufacturing process. The inner body 16 further comprises a closable inlet (not shown) for providing a means to inflate the inner body 16 once disposed inside chamber 32 in order to provide structural support to the outer body 14.

Figure 2:
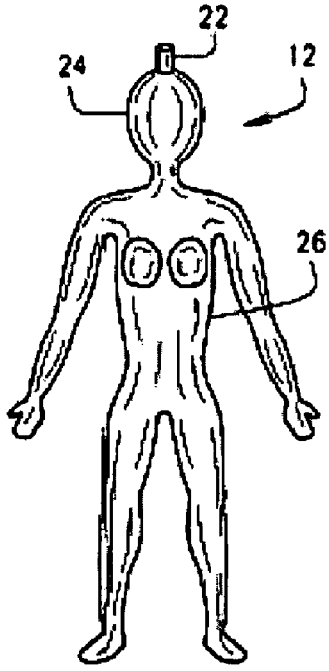
FIG. 2 is a front view of the mould used to manufacture the seamless life-like mannequin according to the present invention.

According to one aspect of the present invention, a process of manufacturing a life-like mannequin 10 having a seamless transition between the head portion 18 and torso portion 20 shall be discussed. Referring to FIG. 2, a life-like mould 12 is provided for producing the latex coating 40 of the outer body 14 during the manufacture of mannequin 10. Preferably, the mould 12 is made of a die-cast metal and is hollow inside such that the weight of mould 12 just exceeds the buoyancy of liquid latex 36 used in the dipping process. As shown, the mould 12 comprises a head member 24 and torso member 26 which define the head portion 18 and torso portion 20, respectively, along with a tubular member 22 extending outwardly from head member 24. During the latex dipping process (FIG. 8D), the mould 12 is dipped in a bath of liquid latex 36 in order to produce the latex coating 40 used for the outer body 14 of mannequin 10.

Figure 8A:
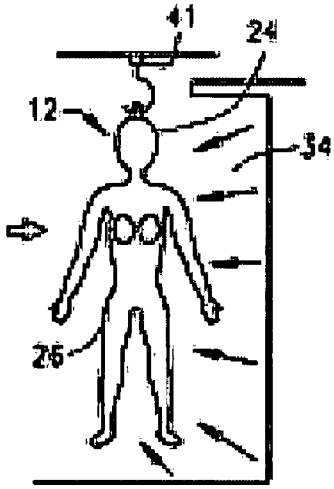
FIGS. 8A-8L illustrate the sequences taken during the process for manufacturing the seamless life-like mannequin according to the present invention.
Figure 8B:
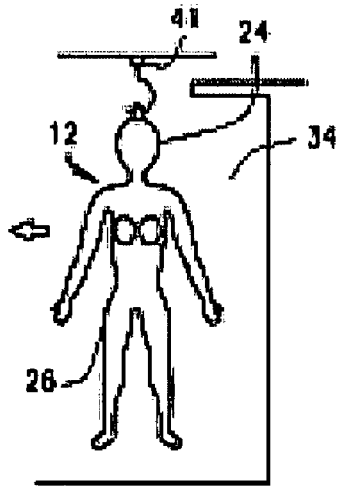

Referring to FIGS. 4 and 8A-8L, the process for manufacturing the mannequin 10 will be discussed in greater detail. At step 50, a life-like human sculpture for mould 12 is produced using techniques known in the art. The mould 12 is then moved into a heating chamber 34 at step 52 for pre-heating the mould 12 at step 54 (FIG. 8A). Preferably, the mould 12 is pre-heated by increasing the temperature to a suitable predetermined threshold and maintaining that temperature for a predetermined amount of time. Preferably, the mould 12 is moved during the manufacturing process using a moving hook assembly 41 attached to the head member 24 of mould 12, although the present invention contemplates that assembly 41 may be attached to any portion of mould 12 for transporting the mould 12 through the manufacturing process.

Figure 8C:
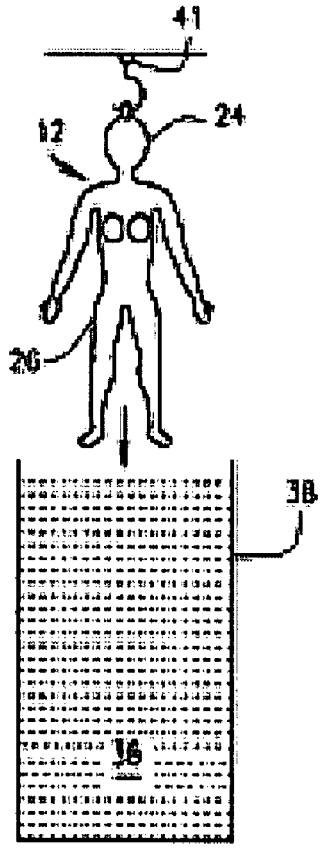
Figure 8D:
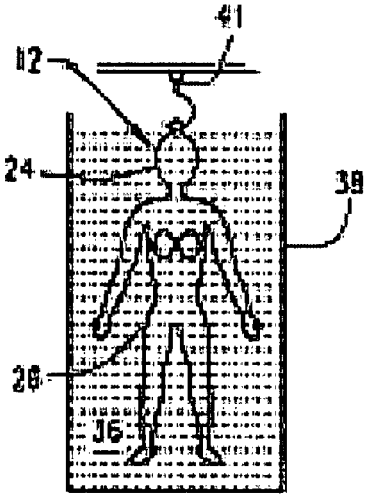
Figure 8E:
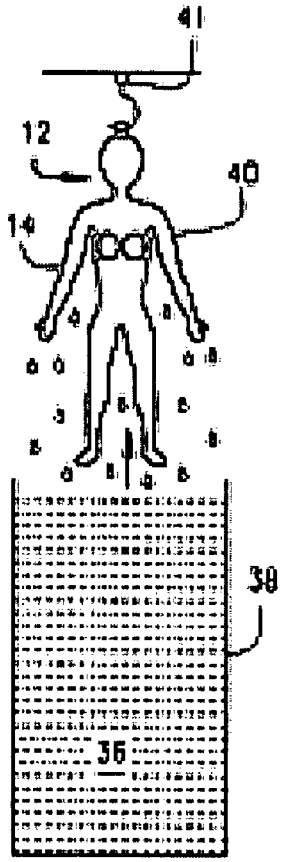
Figure 8F:
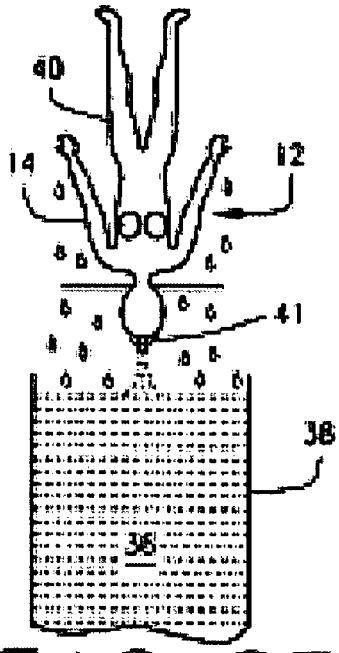

Once pre-heated, the mould 12 is removed from the heating chamber 34 (FIG. 8B) at step 56 and completely immersed into a dipping tank 38 containing liquid latex 36 for a predetermined amount of time at step 58 sufficient for producing a latex coating 40 along the head member, torso member, and tubular member with the latex coating 40 on mould 12 having an inner surface 46 and outer surface 48 (FIGS. 8C-D). As illustrated in FIGS. 8E and 8F, the mould 12 is then removed from the dipping tank 38 at step 60 and turned upside down such that the latex coating 40 can drip off excess liquid latex 36 over a period of time.

Figure 8G:
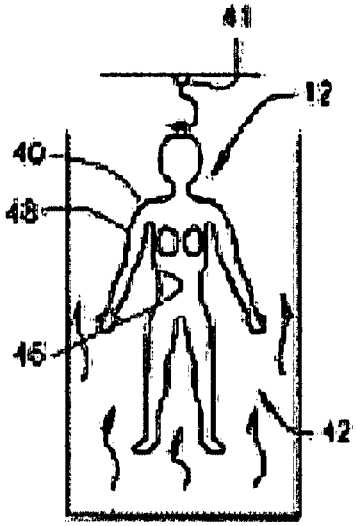
Figure 8H:
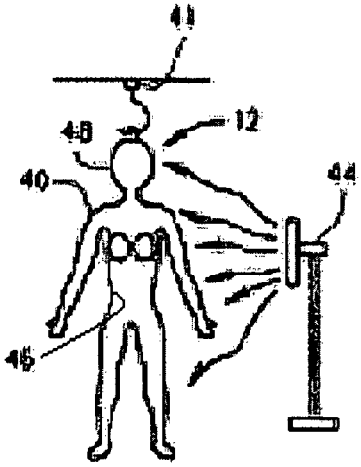

At steps 62 and 64, the latex coating 40 on mold 12 is heated in a heating oven 42 for a predetermined period of time such that the latex coating 40 is allowed to solidify (FIG. 8G). Once the latex coating 40 solidifies, the mold 12 is removed from the heating oven 42 and transferred to an area suitable for cooling the latex coating 40 on mold 12 (FIG. 8H). In addition, a fan 44 may be utilized at step 68 to cool the latex coating 40 on mold 12, although other suitable means for cooling, such as forced air blowers or the like for generating air flow, are contemplated by the present invention.

Figure 8I:
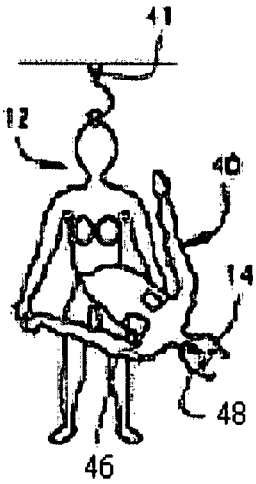
Figure 8J:
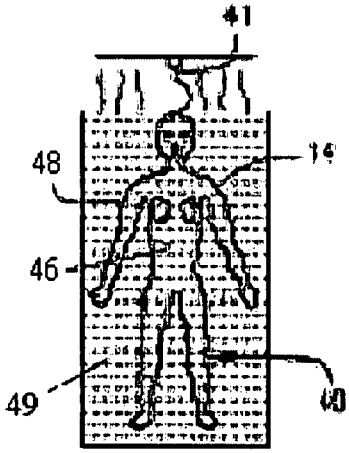
Figure 8K:
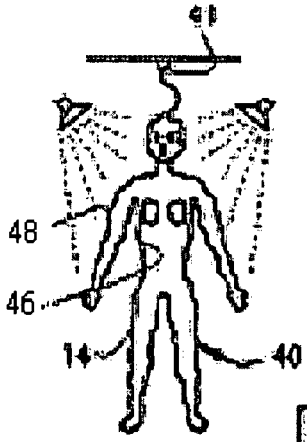
Figure 8L:
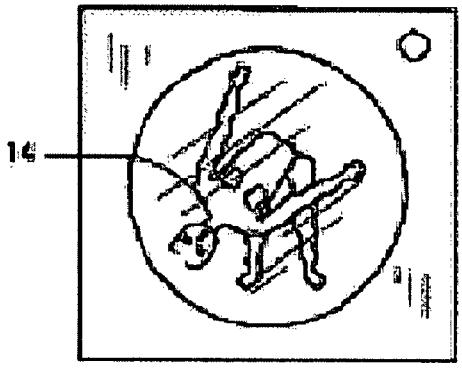

After the latex coating 40 has sufficiently dried, talcum powder is preferably applied to the outer surface 48 at step 70 and the latex coating 40 is then peeled off the mould 12 in an inside out fashion such that the inner surface 46 is exposed using techniques known in the art in order to provide the outer body 14 of mannequin 10 (FIG. 8I). At step 72, the outer body 14 is immersed in hot water 49 for washing and cleaning (FIG. 8J). The outer body 14 is then rinsed in a shower preferably at least three times (FIG. 8K) at step 74. As illustrated in FIG. 8L, the outer body 14 of mannequin 10 is then dried at step 76.

Once these steps of manufacturing the outer body 14 are completed, the hollow tubular portion 28 formed during the dipping process by the tubular member 22 of the mould 12 is removed from the head portion 18 such that an opening 30 is exposed along the top of head portion 18. Preferably, the inner body 16 is made from a sheet of polyvinyl chloride (PVC) to form an inflatable inner mannequin enclosure that substantially conforms to the approximate shape of the outer body 14 when inflated through the inlet by the user.

Figure 7:
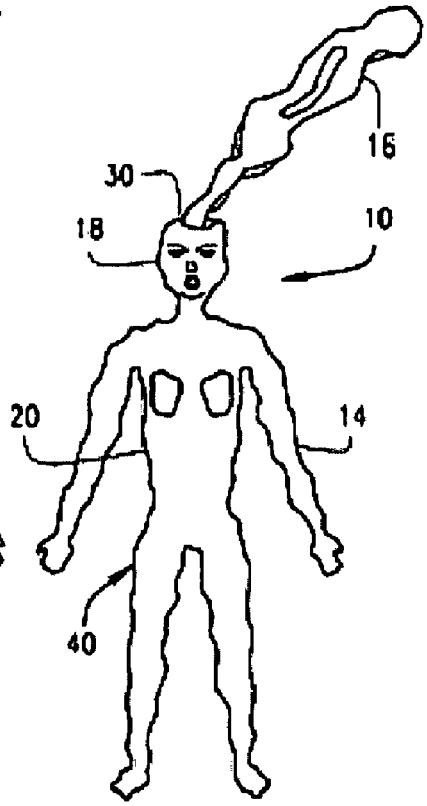
FIG. 7 is a front view of the latex outer body with the inner body being inserted through the opening of the head portion according to the present invention.
Figure 4:
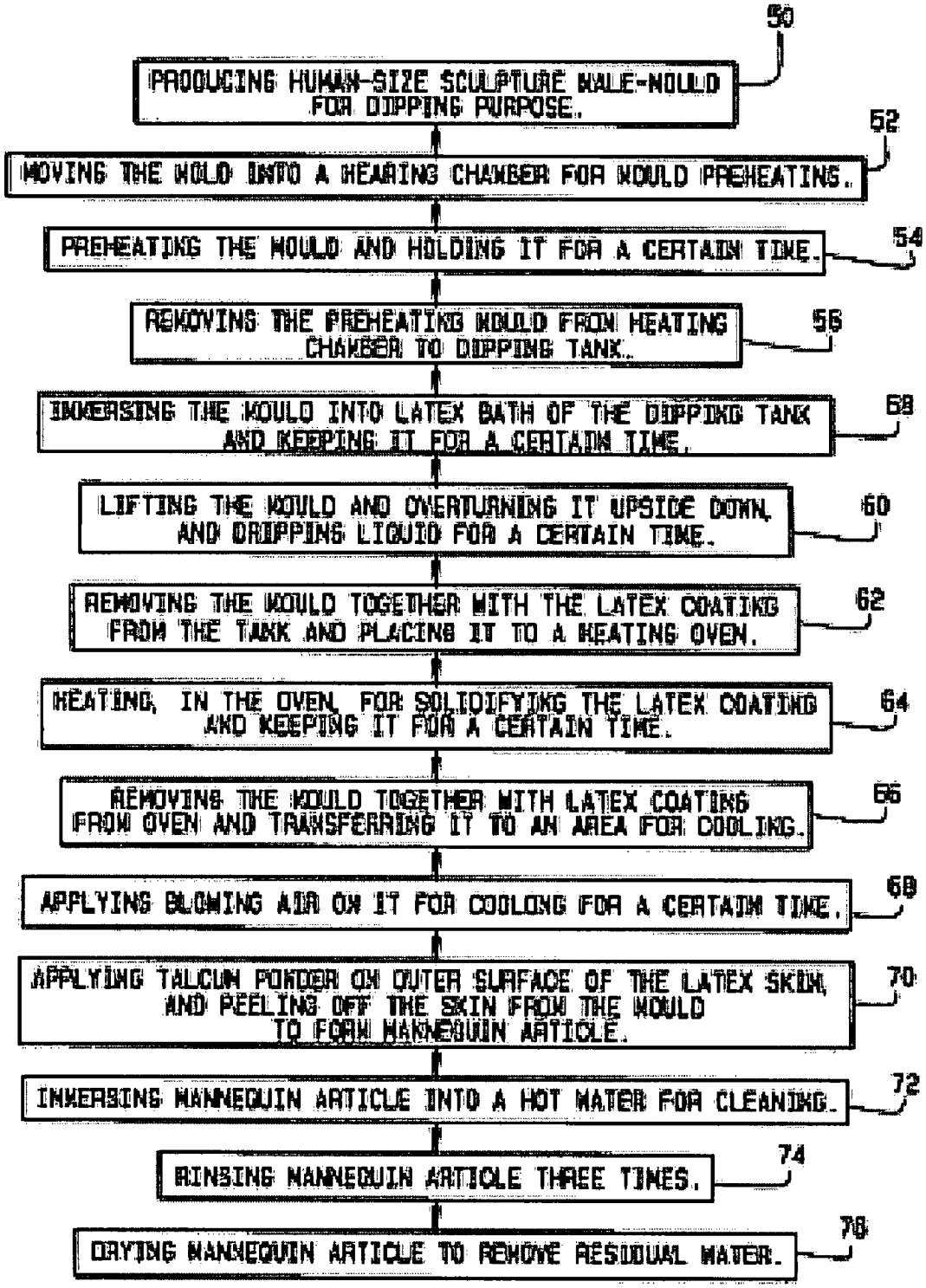
FIG. 4 is a flow chart illustrating the process of manufacturing the seamless life-like mannequin according to the present invention.

Referring to FIG. 7, when the inner body 16 and outer body 14 are in a deflated condition, inner body 16 is inserted through opening 30 formed along head portion 18 by sufficiently stretching the opening 30 to allow insertion of the inner body 16 therein and orienting the various portions of the inner body 16 within the chamber 32 either manually or utilizing tools known in the art. Once the inner body 16 is disposed inside chamber 32 of the outer body 14, the inner body 16 and outer body 14 are inflated using respective inlets (not shown) that provide a means of inflating each respective body 14, 16. After inflation, a wig 37 may be placed on head portion 18 to cover opening 30 and to provide a realistic appearance to mannequin 10.

It should be understood from the foregoing that, while particular embodiments of the invention have been illustrated and described, various modifications can be made thereto without departing from the spirit and scope of the invention as will be apparent to those skilled in the art. Such changes and modifications are within the scope and teaching of this invention as defined in the claims appended hereto.

What is claimed is:

1. A seamless life-like mannequin comprising:

a unitary inflatable outer body defining a chamber, said outer body including a torso portion and a head portion, and an inflatable inner body disposed inside said chamber of said outer body to provide structural support for said outer body when inflated, wherein said outer body has a seamless transition between said torso portion and said head portion, wherein each of said inflatable inner body and said inflatable outer body is capable of being separately inflated, wherein said head portion defines an opening for receiving the inflatable inner body.

2. The seamless life-like mannequin according to claim 1, wherein said outer body is of unitary construction.

3. A seamless life-like mannequin comprising:

a unitary inflatable outer body defining a chamber, said outer body including a torso portion and a head portion, and the outer body being a mannequin skin of realistic human features, the skin being formed with said torso portion and head portion of latex as a result of dipping a mould of a figure of human life-like form into liquid latex such that the skin has a seamless transition between a torso portion and a head portion of the mannequin, an inflatable inner body disposed inside said chamber of said outer body to provide structural support for said outer body when inflated, wherein each of said inflatable inner body and said inflatable outer body is capable of being separately inflated.

* * * * *